US011548749B2

(12) United States Patent
Ikegami et al.

(10) Patent No.: US 11,548,749 B2
(45) Date of Patent: Jan. 10, 2023

(54) IMAGE FORMING APPARATUS

(71) Applicant: BROTHER KOGYO KABUSHIKI KAISHA, Nagoya (JP)

(72) Inventors: Yusuke Ikegami, Aichi (JP); Shintaro Sakaguchi, Aichi (JP); Toshiyuki Sano, Aichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 192 days.

(21) Appl. No.: 17/144,726

(22) Filed: Jan. 8, 2021

(65) Prior Publication Data

US 2021/0214180 A1 Jul. 15, 2021

(30) Foreign Application Priority Data

Jan. 10, 2020 (JP) ..... JP2020-002885

(51) Int. Cl.
*B65H 29/60* (2006.01)
*B65H 7/14* (2006.01)
(Continued)

(52) U.S. Cl.
CPC ..... *B65H 29/60* (2013.01); *B65H 5/26* (2013.01); *B65H 7/14* (2013.01); *B65H 85/00* (2013.01); *G03G 15/6529* (2013.01); *G03G 15/6573* (2013.01); *G03G 21/1633* (2013.01); *B65H 2402/441* (2013.01); *B65H 2402/45* (2013.01); *B65H 2404/611* (2013.01); *B65H 2404/632* (2013.01); *B65H 2407/20* (2013.01); *B65H 2601/11* (2013.01); *B65H 2601/26* (2013.01); *B65H 2801/06* (2013.01)

(58) Field of Classification Search
CPC ..... B65H 29/60; B65H 2404/632; B65H 2402/45; B65H 2601/11; G03G 21/1623; G03G 2215/00544
See application file for complete search history.

(56) References Cited

U.S. PATENT DOCUMENTS 8,989,651 B2 * 3/2015 Mori ..... G03G 21/1638 399/401
10,604,370 B2 * 3/2020 Yamamoto ..... B65H 31/24
(Continued)

FOREIGN PATENT DOCUMENTS

JP 3-098059 A 4/1991
JP 2000-086013 A 3/2000
(Continued)

*Primary Examiner* — Jeremy R Severson
(74) *Attorney, Agent, or Firm* — Merchant & Gould P.C.

(57) ABSTRACT

In an image forming apparatus, a sheet is guided into a first conveyor path or a second conveyor path selectively when a first cover is in a closed position, and is ejected onto the first cover when the first cover is in an open position. Upon power-up, a controller causes a first conveyor roller to rotate but if the first cover is in the open position, when a sheet sensor detects a sheet, the controller does not cause a second conveyor roller to rotate, and causes a flapper to swing from a first position to a second position, and when a front end of the sheet reaches a position downstream of an upstream end of the flapper in a conveyance direction of the sheet conveyed by the first conveyor roller, the controller causes the flapper to swing from the second position to the first position.

8 Claims, 8 Drawing Sheets

(51) Int. Cl.

| | |
|---|---|
| ***G03G 15/00*** | (2006.01) |
| ***G03G 21/16*** | (2006.01) |
| ***B65H 5/26*** | (2006.01) |
| ***B65H 85/00*** | (2006.01) |

(56) References Cited

U.S. PATENT DOCUMENTS

| | | | | |
|---|---|---|---|---|
| 11,099,514 | B2 * | 8/2021 | Kamikawa | G03G 21/1633 |
| 11,262,684 | B2 * | 3/2022 | Ikegami | B65H 29/12 |
| 2015/0274469 | A1 | 10/2015 | Mori et al. | |

FOREIGN PATENT DOCUMENTS

| | | | |
|---|---|---|---|
| JP | 2002-145504 | A | 5/2002 |
| JP | 2016-071224 | A | 5/2016 |

* cited by examiner

IMAGE FORMING APPARATUS

CROSS-REFERENCE TO RELATED APPLICATION(S)

This application claims priority from Japanese Patent Application No. 2020-002885 filed on Jan. 10, 2020, the disclosure of which is incorporated herein by reference in its entirety.

TECHNICAL FIELD

Apparatuses disclosed herein relate to an image forming apparatus of which a housing is provided with an opening that is openably closed with a cover.

BACKGROUND ART

An image forming apparatus known in the art comprises a housing provided with an output tray on an upper surface thereof, an image forming unit configured to form an image on a sheet, a rear cover so provided at a rear side of the housing as to make up part of a conveyor path for guiding a sheet from the image forming unit toward the output tray, and a conveyor roller configured to convey a sheet in the conveyor path. The cover is configured to be openable and closeable, i.e., moveable to an open position and to a closed position relative to the housing. When the cover is in the closed position and forms the conveyor path, a sheet with an image formed thereon is guided by the conveyor path, conveyed by the conveyor roller and ejected onto the output tray; on the other hand, when the rear cover is in an open position, a sheet with an image formed thereon is ejected onto the rear cover.

SUMMARY

When the rear cover is in the open position, the conveyor roller is uncovered. Therefore, anything would possibly touch the exposed conveyor roller which may be rotating when a sheet is ejected onto the rear cover, with the result that an undesirable load could be imposed on the conveyor roller.

There is a need to provide an image forming apparatus in which the potential risk of imposing an undesirable load on the conveyor roller can be reduced.

In one aspect, an image forming apparatus is disclosed herein, which comprises a housing, a process unit, a first conveyor roller, a second conveyor roller, an output tray, a first conveyor path, a second conveyor path, a first cover, a flapper, a biasing member, an actuator, a sheet sensor, and a controller. The process unit is configured to transfer a toner image onto a sheet. The first conveyor roller is configured to convey the sheet conveyed from the process unit. The output tray is configured to support a sheet. The first conveyor path is provided within the housing, and configured to guide the sheet conveyed by the first conveyor roller toward the output tray. The second conveyor path is a path branching off from the first conveyor path, and configured to guide the sheet conveyed by the first conveyor roller toward outside of the housing. The second conveyor roller is configured to convey the sheet in the second conveyor path. The first cover is provided swingably relative to the housing between a closed position and an open position. The first cover in the closed position makes up at least part of the second conveyor path and covers the second conveyor roller. The first cover in the open position uncovers the second conveyor roller. The flapper is provided swingably between a first position and a second position. When the first cover is in the closed position, the flapper in the first position guides the sheet conveyed by the first conveyor roller into the first conveyor path. When the first cover is in the closed position, the flapper in the second position guides the sheet conveyed by the first conveyor roller into the second conveyor path. When the first cover is in the open position, the flapper guides the sheet conveyed by the first conveyor roller to eject the sheet onto the first cover. The biasing member is configured to bias the flapper toward the first position. The actuator is configured to cause the flapper to swing from the first position to the second position. The sheet sensor is configured to detect a conveyed sheet at a position between the process unit and the flapper.

The controller is configured such that: upon power-up of the image forming apparatus, the first conveyor roller is caused to rotate; and if the first cover is in the open position, when the sheet sensor detects a sheet, the second conveyor roller is not caused to rotate, and the flapper is caused, by the actuator, to swing from the first position to the second position, and when a front end of the sheet reaches a position downstream of an upstream end of the flapper in a conveyance direction of the sheet conveyed by the first conveyor roller, the flapper is caused, by the actuator, to swing from the second position to the first position.

The controller may also be configured such that: if the first cover is in the open position, when the sheet sensor detects a sheet after the first conveyor roller is caused to rotate, the second conveyor roller is not caused to rotate, and the flapper is caused, by the actuator, to swing from the first position to the second position, and when a front end of the sheet reaches a position downstream of an upstream end of the flapper in a conveyance direction of the sheet conveyed by the first conveyor roller, the flapper is caused, by the actuator, to swing from the second position to the first position.

With these configurations, the flapper may be caused to swing from the second position to the first position at an adequately-specified time, and the front end of the conveyed sheet can thus be flapped and directed toward the first cover, so that the sheet can be ejected reliably onto the first cover without fail. During this process, the second conveyor roller uncovered when the first cover is in the open position is not caused to rotate; therefore, even if anything would contact the exposed second conveyor roller, an undesirable overload which would be imposed by such contact if the second conveyor roller is rotating can be made less likely to be imposed on the second conveyor roller.

BRIEF DESCRIPTION OF THE DRAWINGS

The above and other aspects, their advantages and further features will become more apparent by describing in detail illustrative, non-limiting embodiments thereof with reference to the accompanying drawings, in which.

DESCRIPTION OF EMBODIMENTS

Figure 1:
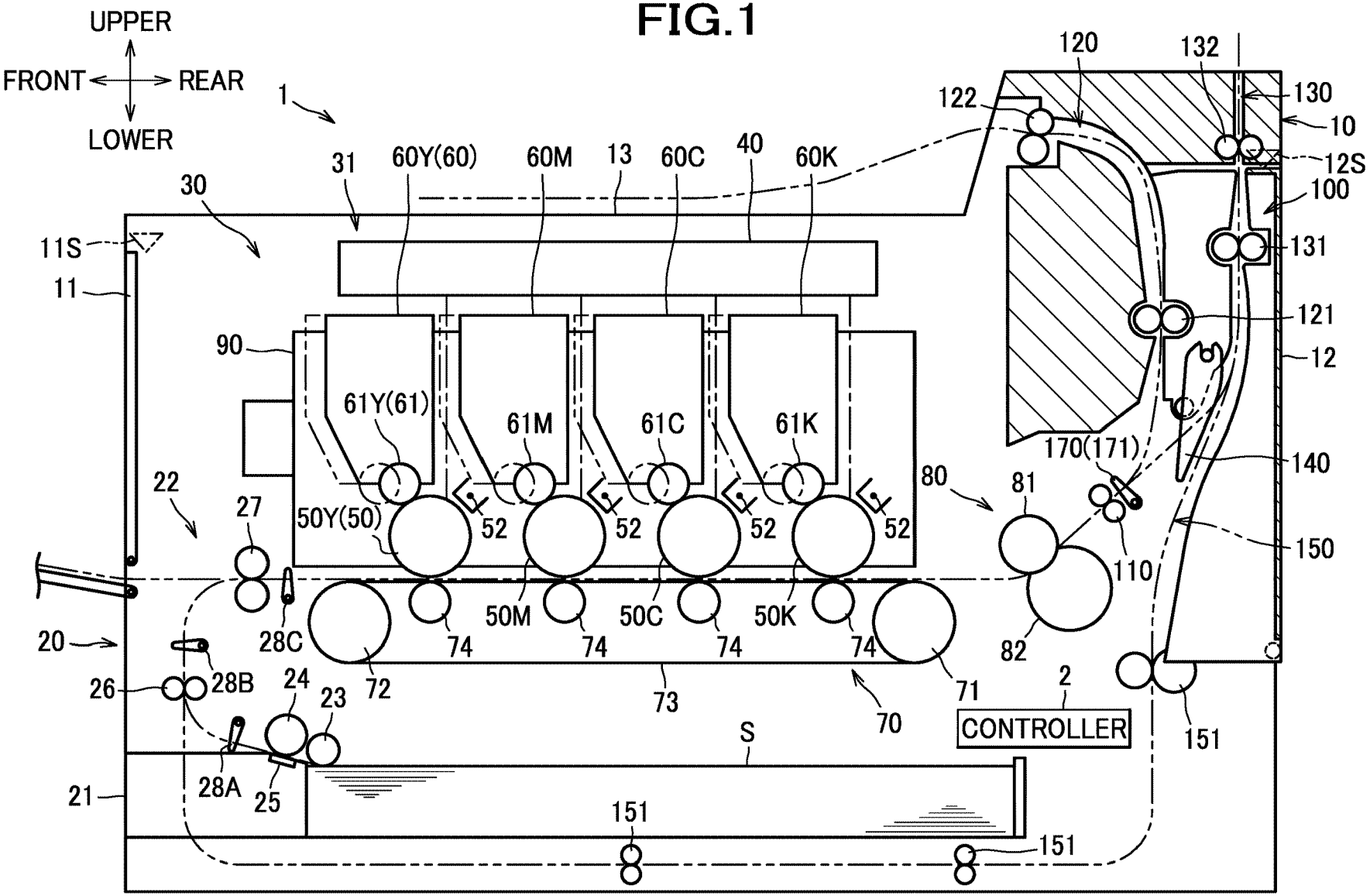
FIG. 1 is a section view of an image forming apparatus.

As shown in FIG. 1, an image forming apparatus 1 illustrated herein is a color printer comprising a housing 10, a front cover 11, a rear cover 12, and an output tray 13. The image forming apparatus 1 further comprises a sheet feeder unit 20 configured to supply sheets S, an image forming unit 30 configured to form an image on a sheet S, and a sheet conveyor unit 100 configured to convey a sheet conveyed from the image forming unit 30, and a controller 2. In this embodiment, the rear cover 12 corresponds to "first cover" mentioned above. In describing the present embodiment, the direction is designated as in FIG. 1 which is a schematic diagram viewed in section from the right side of the printer; that is, the left-hand side of the drawing sheet corresponds to the front side of the printer, the right-hand side of the drawing sheet corresponds to the rear side of the printer, the upper side (topside) of the drawing sheet corresponds to the upper side (topside) of the printer, and the lower side (bottom side) of the drawing sheet corresponds to the lower side (underside or bottom side) of the printer. The direction of a line extending upward and/or downward may be referred to as "upward-downward direction".

The housing 10 has a front-side opening and a rear-side opening provided with a front cover 11 and a rear cover 12, respectively.

The front cover 11 is supported swingably on the housing 10 so that the front-side opening of the housing 10 is openably closed by the front cover 11. Although not illustrated, the front cover 11 is swingable relative to the housing 10 between a closed position in which the front-side opening of the housing 10 is closed and an open position in which the front-side opening of the housing 10 is uncovered. The image forming apparatus 1 includes a front cover sensor 11S configured to detect the presence of the front cover 11 in the open or closed position and produce a detection signal indicative of the position (i.e., the open/closed state) of the front cover 11. The controller 2 is capable of making a determination based upon the detection signal received from the front cover sensor 11S as to the open/closed state of the front cover 11, i.e., whether the front cover 11 is in the closed position or in the open position.

Figure 4:
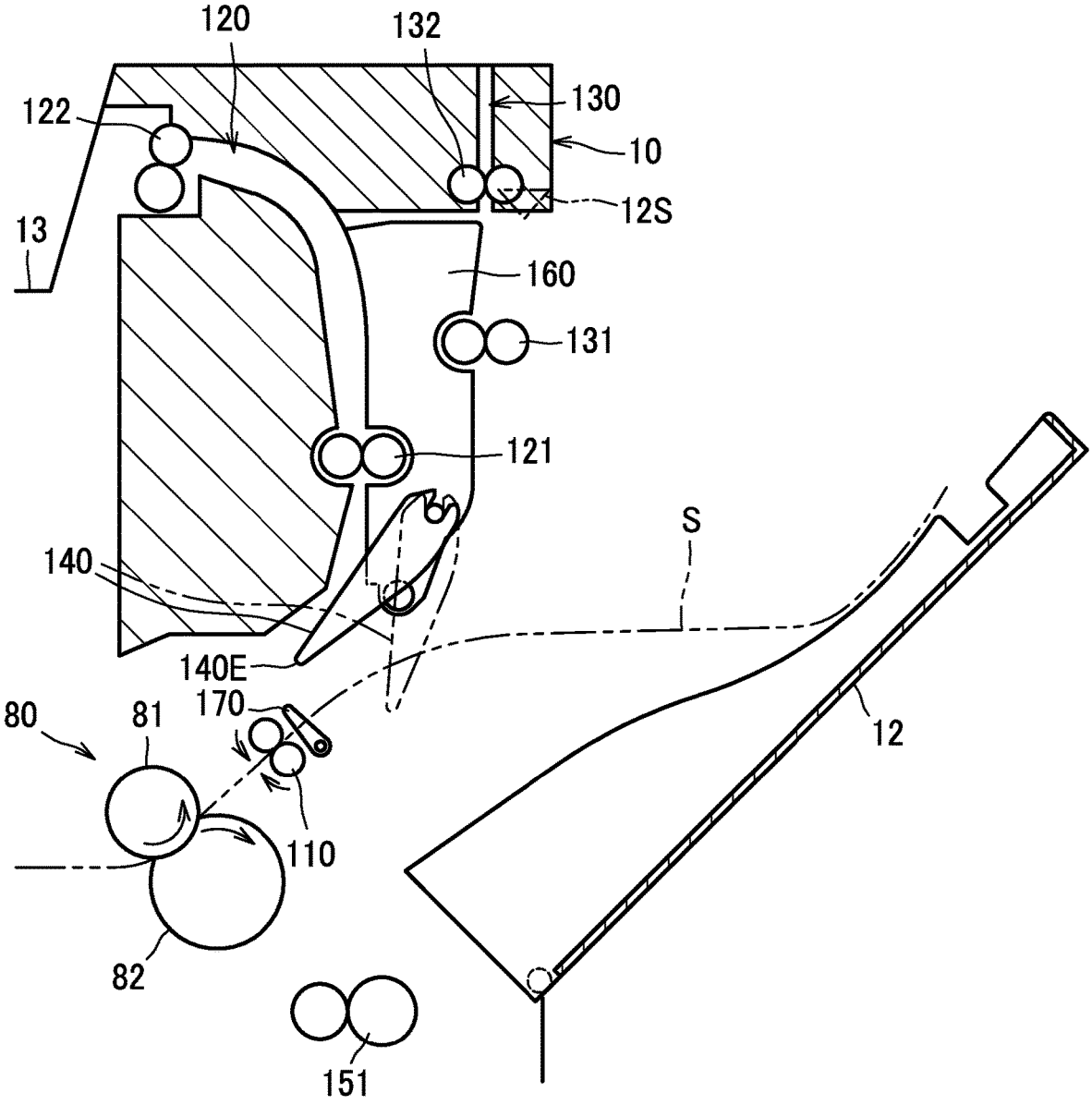
FIG. 4 is a section view of the sheet conveyor unit in such a state as exhibited when the rear cover is in an open position, the flapper is the second position, and an inner cover is in a third position.

The rear cover 12 is supported swingably on the housing 10 so that the rear-side opening of the housing 10 is openably closed by the rear cover 12. Specifically, the rear cover 12 is swingable relative to the housing 10 between a closed position as shown in FIG. 1 and an open position as shown in FIG. 4. The image forming apparatus 1 includes a rear cover sensor 12S configured to detect the presence of the rear cover 12 in the open or closed position and produce a detection signal indicative of the position (i.e., the open/closed state) of the rear cover 12. The controller 2 is capable of making a determination based upon the detection signal received from the rear cover sensor 12S as to the open/closed state of the rear cover 12, i.e., whether the rear cover 12 is in the closed position or in the open position.

Referring back to FIG. 1, the output tray 13 is provided on a top part of the housing 10 and configured to support a sheet S ejected or outputted from inside the housing 10. In this description, the sheet(s) S refers to a medium on which an image can be formed by the image forming apparatus 1, and includes a sheet of plain paper (thin or thick), an envelope, a postcard, a flimsy, a cardboard, a sheet of glossy paper, plastic film, a peel-off sticker, etc.

The sheet feeder unit 20 includes a sheet feed tray 21 configured to support sheets S, and a sheet feed mechanism 22. The sheet feed tray 21 is located under the image forming unit 30, and can be pulled out toward the front and removed from the housing 10. The sheet feed mechanism 22 includes a pickup roller 23, a separator roller 24, a separator pad 25, conveyor rollers 26, and registration rollers 27.

In the sheet feeder unit 20, sheets S stored in the sheet feed tray 21 are fed by the pickup roller 23 toward the separator pad 25, and one sheet is separated from subsequent sheets on the separator pad 25 by the separator roller 24, and conveyed by the conveyor rollers 26 toward the registration rollers 27. Thereafter, the sheet S comes in contact with the registration rollers 27 temporarily at rest so that the front edge of the sheet is brought into line with the registration rollers 27 at standstill, before the registration rollers 27 start rotating to feed the sheet to the image forming unit 30.

The image forming apparatus 1 includes a sheet feed sensor 28A, a pre-registration sensor 28B, and a post-registration sensor 28C each of which is configured to detect a sheet S at its relevant location. The sheet feed sensor 28A is located in a position downstream of the pickup roller 23 and the separator roller 24 in a conveyance direction of a sheet S conveyed from the sheet feed tray 21 to the image forming unit 30. The pre-registration sensor 28B is located in a position downstream of the sheet feed sensor 28A and the conveyor rollers 26 and upstream of the registration rollers 27 in the conveyance direction of the sheet S. The post-registration sensor 28C is located in a position downstream of the registration rollers 27 and upstream of the image forming unit 30 in the conveyance direction of the sheet S.

The image forming unit 30 includes a process unit 31 configured to transfer a toner image onto a sheet S, and a fixing device 80 configured to cause the toner image transferred onto the sheet S in the process unit 31 to be fixed on the sheet S. The process unit 31 includes an exposure device 40, a plurality of photoconductor drums 50, a plurality of development cartridges 60, and a transfer unit 70. The process unit 31 is configured to be capable of transferring a toner image in a plurality of colors onto a sheet S.

The exposure device 40 includes a laser diode, a deflector, lenses and mirrors which are not illustrated in the drawings. The exposure device 40 is configured to emit a plurality of light beams indicated by alternate long and short dashed lines, each of the light beams being directed to a corresponding photoconductor drum 50 so that a surface of each photoconductor drum 50 is exposed to the corresponding light beam.

The photoconductor drums 50 include a first photoconductor drum 50Y on which a yellow toner image is to be formed, a second photoconductor drum 50M on which a magenta toner image is to be formed, a third photoconductor drum 50C on which a cyan toner image is to be formed, and a fourth photoconductor drum 50K on which a black toner image is to be formed. The first, second, third and fourth photoconductor drums 50Y, 50M, 50C, 50K are arranged in this order from upstream toward downstream along the conveyance direction of a sheet S in the image forming unit 30.

The development cartridges 60 are provided one for each of the plurality of the photoconductor drums 50. The development cartridges 60 include a first development cartridge 60Y, a second development cartridge 60M, a third development cartridge 60C, and a fourth development cartridge 60K. The first development cartridge 60Y includes a first development roller 61Y for supplying yellow toner to the first photoconductor drum 50Y. The second development cartridge 60M includes a second development roller 61M for supplying magenta toner to the second photoconductor drum 50M. The third development cartridge 60C includes a third development roller 61C for supplying cyan toner to the third photoconductor drum 50C. The fourth development cartridge 60K includes a fourth development roller 61K for supplying black toner to the fourth photoconductor drum 50K.

Each development cartridge 60 is movable between a position represented by a solid line in FIG. 1 where the development roller 61 is in a contact position, i.e., kept in contact with a corresponding photoconductor drum 50 and a position represented by a chain double-dashed line in FIG. 1 where the development roller 61 is in a separate position, i.e., kept apart from the corresponding photoconductor drum 50.

The plurality of photoconductor drums 50 are rotatably supported by a support member 90. The support member 90 includes chargers 52 located in positions corresponding to the respective photoconductor drums 50; each charger 52 is configured to charge a corresponding photoconductor drum 50. The support member 90 is installable in and removable from the housing 10 through the front-side opening of the housing 10, which is uncovered and made available when the front cover 11 is swung open. The support member 90 is also configured to support the plurality of development cartridges 60 in a manner that permits each development cartridge 60 to be installable in and removable from the support member 90. The plurality of development cartridges 60 are supported by the support member 90 in such a manner that the development rollers 60 are caused to move to the contact positions by the swinging-open motion of the front cover 11.

The transfer unit 70 is provided between the sheet feed tray 21 and the plurality of photoconductor drums 50. The transfer unit 70 includes a drive roller 71, a follower roller 72, a conveyor belt 73 configured as an endless belt, and four transfer rollers 74. The conveyor belt 73 is looped around and run between the drive roller 71 and the follower roller 72, with its outer surface facing each of the photoconductor drums 50. The transfer rollers 74 are located inside the conveyor belt 73, and so arranged that the conveyor belt 73 is held between each transfer roller 74 and the corresponding photoconductor drum 50.

The fixing device 80 is provided rearward of the plurality of photoconductor drums 50 and the transfer unit 70. The fixing device 80 includes a heating roller 81, and a pressure roller 82 disposed opposite to the heating roller 81.

In the image forming unit 30, a surface of each photoconductor drum 50 is uniformly charged by the charger 52 and then exposed to a light beam emitted from the exposure device 40. In this way, an electrostatic latent image formulated based upon image data is formed on the surface of the photoconductor drum 50. Toner stored in the development cartridge 60 is carried on a surface of the development roller 60, and supplied from the development roller 61 located in the contact position to an electrostatic latent image formed on the surface of the photoconductor drum 50. Accordingly, a toner image is formed on the surface of the photoconductor drum 50. Next, a sheet S fed onto the conveyor belt 73 is conveyed on the conveyor belt 73 and caused to pass through between the photoconductor drum 50 and the transfer roller 74, so that the toner image on the photoconductor drum 50 is transferred onto the sheet S. Subsequently, the sheet S passes through between the heating roller 81 and the pressure roller 82, so that the toner image is thermally fixed on the sheet S.

The sheet conveyor unit 100 includes conveyor rollers 110, a first conveyor path 120, first ejector rollers 121, second ejector rollers 122, a second conveyor path 130, first rotation-reversible rollers 131, second rotation-reversible rollers 132, a flapper 140, a third conveyor path 150, and reverse rollers 151. In this embodiment, the conveyor rollers 110 correspond to "first conveyor roller", the first rotation-reversible rollers 131 correspond to "second conveyor roller", and the first ejector rollers 121 correspond to "third conveyor roller".

The conveyor rollers 110 are used in a pair as a roller unit configured to convey a sheet S conveyed from the process unit 31. In this embodiment, the conveyor rollers 110 are located downstream of the fixing device 80 in a conveyance direction of a sheet S in the image forming unit 30. Thus, the conveyor rollers 110 convey a sheet S conveyed from the fixing device 80 (i.e., image forming unit 30).

The first conveyor path 120 is a guide path provided within the housing 10 and configured to guide a sheet S conveyed by the conveyor rollers 110 toward the output tray 13. The first conveyor path 120 extends from a position near the conveyor rollers 110 in an upward direction, and is curved frontward toward the output tray 13 provided in front thereof. The first conveyor path 120 is located behind the second conveyor path 130 as viewed from the rear cover 12 in the closed position. To be more specific, the rear cover 12 in the closed position is located at the rear side of the second conveyor path 130, and the first conveyor path 120 is located at the front side of the second conveyor path 130.

The first ejector rollers 121 are used in a pair as a roller unit configured to convey a sheet S in the first conveyor path 120. The second ejector rollers 122 are used in a pair as a roller unit configured to convey a sheet S to the output tray 13 outside of the housing 10.

The second conveyor path 130 is a guide path branching off from the first conveyor path 120 and configured to guide a sheet S conveyed by the conveyor rollers 110 toward the outside of the housing 10. The second conveyor path 130 branching off from the first conveyor path 120 extends in an obliquely-rearward-and-upward direction, and is curved upward to the upper surface of the housing 10.

The first rotation-reversible rollers 131 and the second rotation-reversible rollers 132 are each used in a pair as a roller unit configured to convey a sheet S in the second conveyor path 130. The first and second rotation-reversible rollers 131, 132 are capable of switching their directions of rotation, and configured to rotate selectively either in a normal direction or in a reverse direction. When a sheet S is to be conveyed toward the outside of the housing 10, the rotation-reversible rollers 131, 132 are caused to rotate in directions as indicated by arrows in FIG. 3 (hereinafter referred to commonly as "normal direction"). The rotation-reversible rollers 131, 132 can be caused to rotate in directions reverse to their respective normal directions (herein after referred to commonly as "reverse direction"). The directions of rotation of the rotation-reversible rollers 131, 132 are switched under control of the controller 2.

The rear cover 12 in the closed position makes up at least part of the second conveyor path 130 and covers the first rotation-reversible rollers 131. On the other hand, as shown in FIG. 4, the rear cover 12 in the open position opens at least part of the second conveyor path 130 and uncovers the first rotation-reversible rollers 131.

Figure 2A:
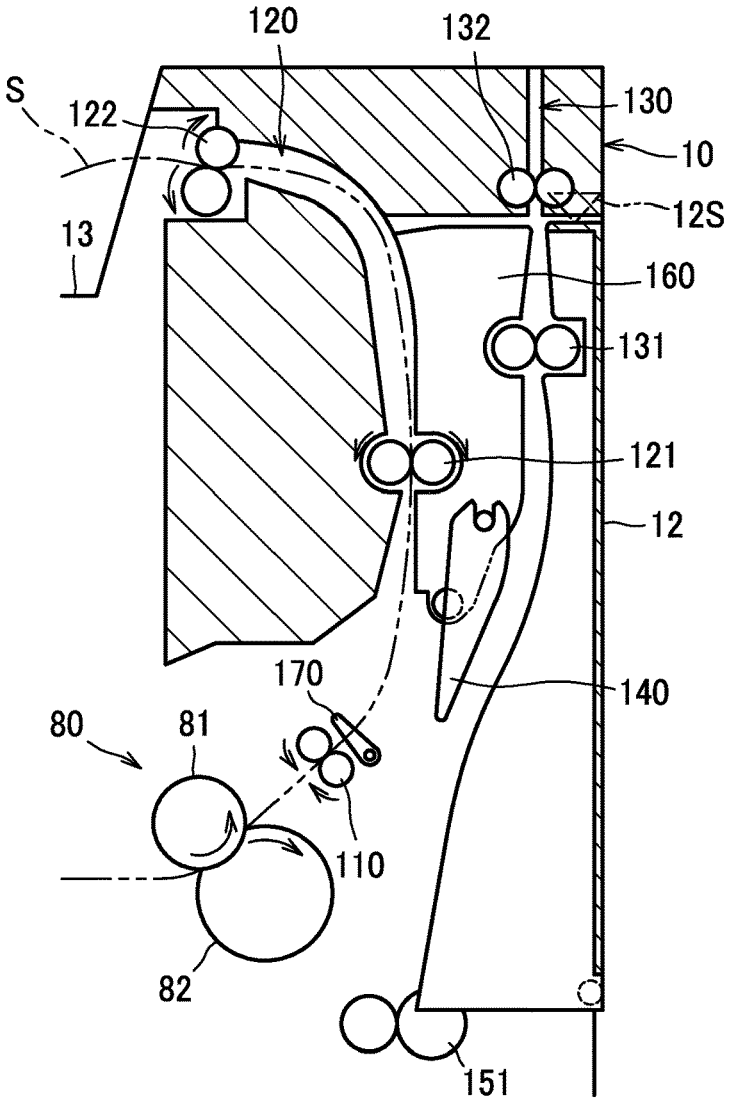
FIG. 2A is a section view of a sheet conveyor unit in such a state as exhibited when a rear cover is in a closed position, and a flapper is in a first position.
Figure 3:
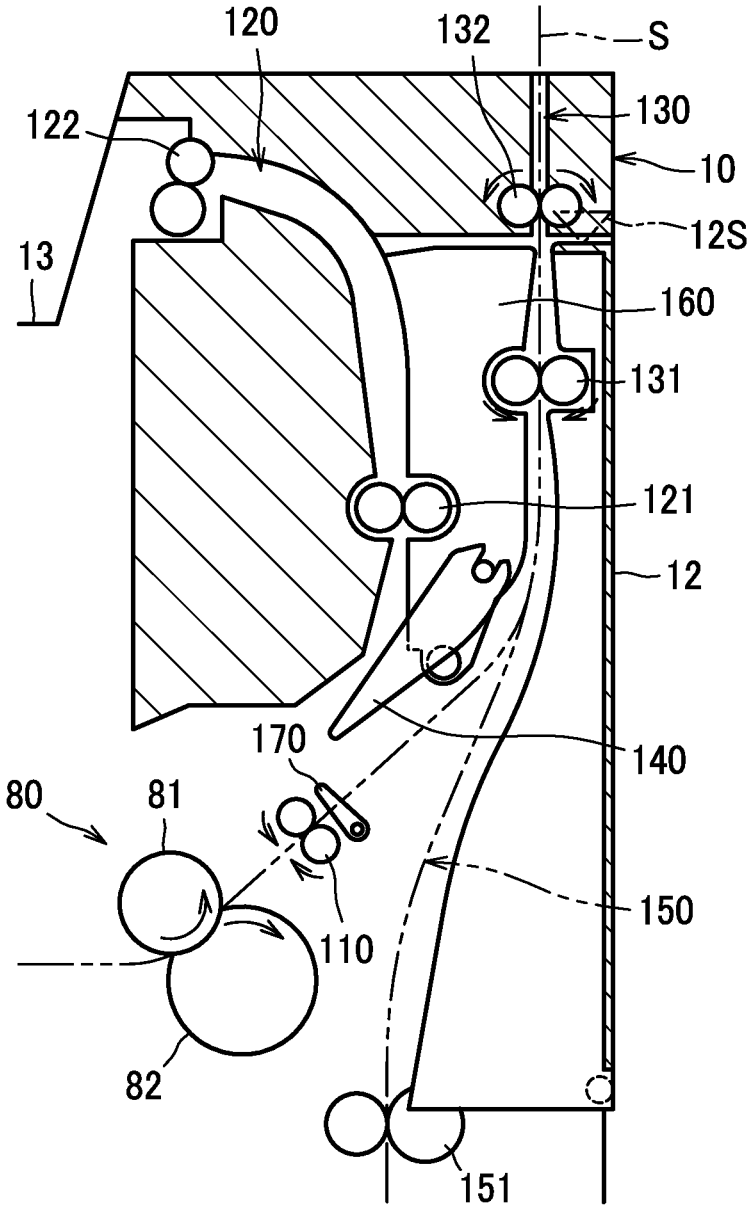
FIG. 3 is a section view of the sheet conveyor unit in such a state as exhibited when the rear cover is in the closed position, and the flapper is in a second position.

The flapper 140 is a member for selectively guiding a sheet conveyed by the conveyor rollers 110 either into the first conveyor path 120 or into the second conveyor path 130, and is provided swingably relative to the housing 10. To be more specific, the flapper 140 is swingable relative to the housing 10 between a first position represented by a chain double-dashed line in FIG. 4 and a second position represented by a solid line in FIG. 4. As shown in FIG. 2A, the flapper 140 in the first position guides a sheet S conveyed by the conveyor rollers 110, into the first conveyor path 120. As shown in FIG. 3, the flapper 140 in the second position guides a sheet S conveyed by the conveyor rollers 110, into the second conveyor path 130.

Figure 2B:
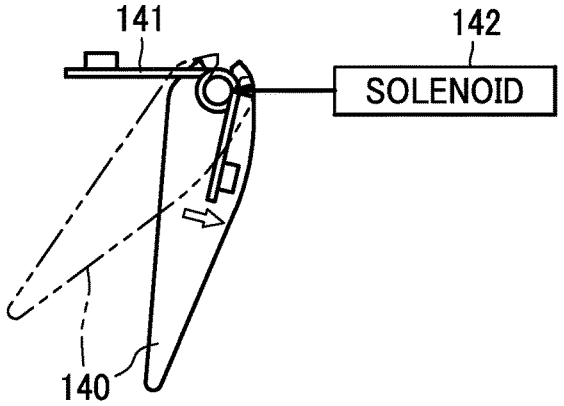
FIG. 2B is a schematic diagram showing a configuration for causing the flapper to move.

As shown in FIG. 2B, the image forming apparatus 1 further includes a spring 141 and a solenoid 142. The spring 141 is configured, for example, as a torsion spring, to bias the flapper 140 toward the first position represented by the solid line. The solenoid 142 is an electromechanical solenoid configured as an actuator to cause the flapper 140 to swing from the first position to the second position represented by the chain double-dashed line. When the solenoid 142 is turned on (energized), the flapper 140 is pushed by the solenoid 142 and caused to swing from the first position to the second position. When the solenoid 142 is turned off (shut off), the flapper 140 is caused to swing by the biasing force of the spring 141 from the second position to the first position. In this embodiment, the spring 141 corresponds to "biasing member", and the solenoid 142 corresponds to "actuator".

As shown in FIG. 1, the third conveyor path 150 is a guide path configured to guide a sheet S having an image formed on a front side thereof, to be conveyed back toward the image forming unit 30 so as to form an image on a back side thereof. The third conveyor path 150 extends from a position near the flapper 140 downward, and is curved to extend under the sheet feed tray 21 frontward, and curved again at a front end of the sheet feed tray 21 to extend upward toward the conveyor rollers 26.

The reverse rollers 151 are comprised of a plurality of pairs of rollers and configured to convey a sheet S in the third conveyor path 150.

The sheet conveyor unit 100 is configured such that when the rear cover 12 is in the closed position, a sheet S conveyed by the conveyor rollers 110 is selectively introduced into and guided by either of the first conveyor path 120 and the second conveyor path 130. To be more specific, as shown in FIG. 2A, in the sheet conveyor unit 100, when the flapper 140 is in the first position, a sheet S conveyed from the fixing device 80 is conveyed by the conveyor rollers 110, and guided by the flapper 140 into the first conveyor path 120. Thereafter, the sheet S is ejected onto the output tray 13 by the first and second ejector rollers 121, 122.

On the other hand, as shown in FIG. 3, in the sheet conveyor unit 100, when the flapper 140 is in the second position, a sheet S conveyed from the fixing device 80 is conveyed by the conveyor rollers 110, and guided by the flapper 140 into the second conveyor path 130. Thereafter, the sheet S is conveyed toward the outside of the housing 10 by the first and second rotation-reversible rollers 131, 132 caused to rotate in the normal direction.

The sheet S guided and introduced into the second conveyor path 130 is conveyed by the rotation-reversible rollers 131, 132 caused to rotate in the normal direction, for example, toward a sheet output unit having a plurality of sheet trays (see JP 2016-071224 A and its family patent applications, for example as published under US 2015/0274469 A1 and U.S. Pat. No. 9,238,562 B2, the disclosures of which are incorporated herein by reference in their entirety), or the like installed atop the image forming apparatus 1. When an image is to be formed on a back side of a sheet S having an image formed on a front side thereof, the sheet S introduced into the second conveyor path 130 is caused to stop by the rotation-reversible rollers 131, 132 stopping its rotation before a rear end of the sheet S passes through the first rotation-reversible rollers 131, and is then conveyed back to the inside of the housing 10 and introduced into the third conveyor path 150 by the rotation-reversible rollers 131, 132 caused to rotate in the reverse direction. Thereafter, the sheet S is conveyed by the reverse rollers 151 and the conveyor rollers 26, etc. so that the sheet S with its back side turned up is fed again to the image forming unit 30.

The sheet conveyor unit 100 is configured such that when the rear cover 12 is in the open position, a sheet S conveyed by the conveyor rollers 110 is ejected out onto the rear cover 12. To be more specific, as shown in FIG. 4, in the sheet conveyor unit 100, when the rear cover 12 is in the open position, the flapper 140 is caused to swing from the first position represented by the chain double-dashed line to the second position represented by the solid line, and the sheet S conveyed from the fixing device 80 is ejected by the conveyor rollers 110 onto the rear cover 12 in the open position.

Figure 5:
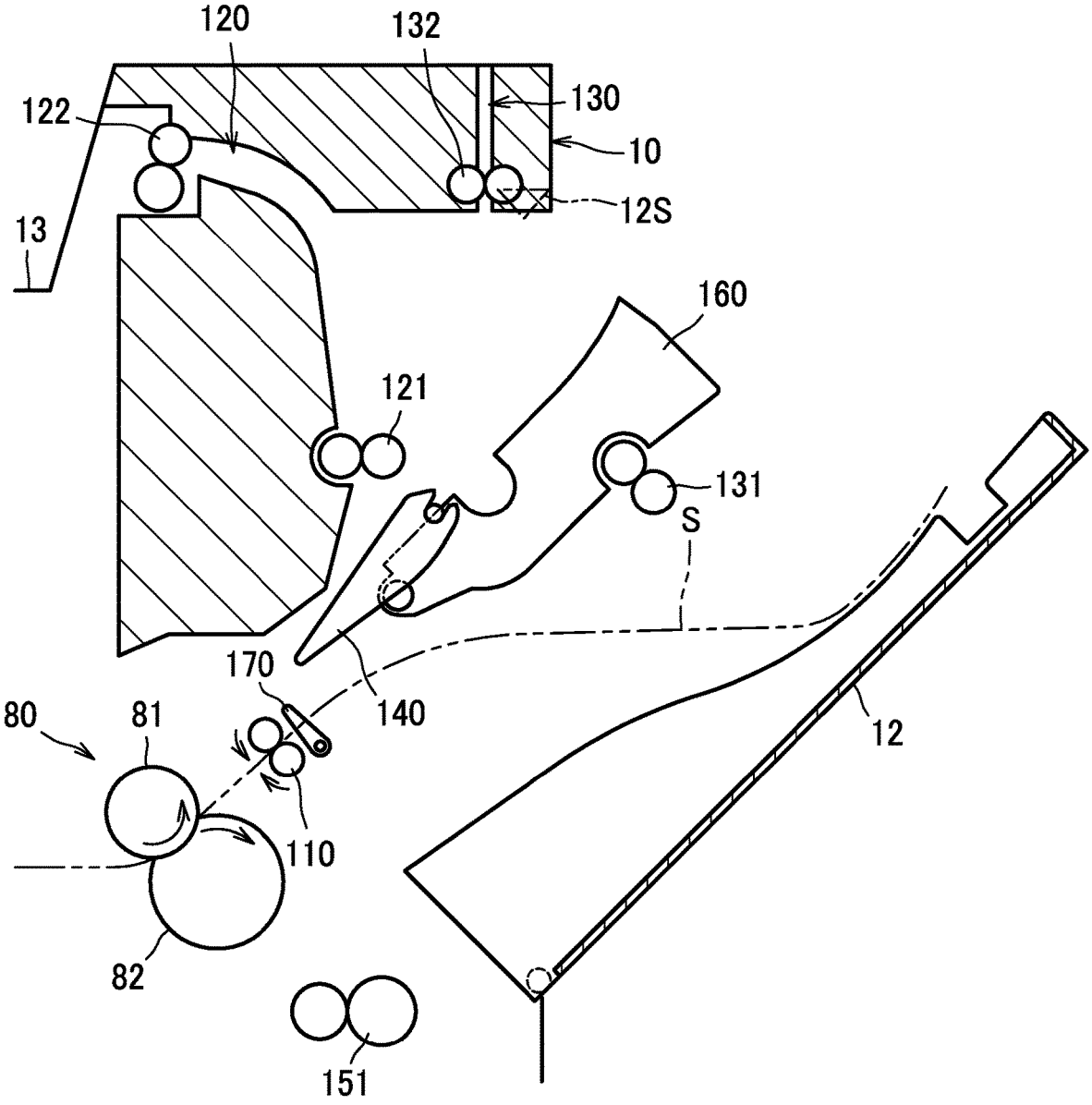
FIG. 5 is a section view of the sheet conveyor unit in such a state as exhibited when the rear cover is in the open position, the flapper is in the second position, and the inner cover is in a fourth position.

As shown in FIG. 4 and FIG. 5, the image forming apparatus 1 further includes an inner cover 160 which is uncovered when the rear cover 12 is in the open position. In this embodiment, the inner cover 160 corresponds to "second cover". The inner cover 160 is supported movably relative to the housing 10. Specifically, the inner cover 160 is swingable relative to the housing 10 between a third position as shown in FIG. 4 and a fourth position as shown in FIG. 5.

As shown in FIG. 4, the inner cover 160 in the third position makes up at least part of the first conveyor path 120, and covers the first ejector rollers 121. On the other hand, as shown in FIG. 5, the inner cover 160 in the fourth position opens at least part of the first conveyor path 120 and uncovers the first ejector rollers 121. As shown in FIG. 3, the inner cover 160 in the third position and the rear cover 12 in the closed position in combination make up at least part of the second conveyor path 130.

As shown in FIG. 1, the image forming apparatus 1 further includes an ejection sensor 170 for detecting a sheet S. In this embodiment, the ejection sensor 170 corresponds to "sheet sensor". The ejection sensor 170 is configured to detect a sheet S when the conveyed sheet S comes in contact with the ejection sensor 170. By way of example, the ejection sensor 70 includes a swing arm 171 supported swingably relative to the housing 10, and an optical sensor (not shown) capable of detecting the swing motion of the swing arm 171.

The optical sensor includes a light-emitting element configured to emit a detectible light beam, and a light-sensitive element configured to receive the detectible light beam from the light-emitting element. The optical sensor is configured, for example, to output an OFF signal when part of the swing arm 171 is interposed between the light-emitting element and the light-sensitive element and cuts off the detectible light beam so that the light-sensitive element fails to receive the detectible light, and to output an ON signal when the swing arm 171 is swung and the part of the swing arm 171 is removed from an optical path between the light-emitting element and the light-sensitive element so that the light-sensitive element receives the detectible light from the light emitting element. In this way, the ejection sensor 170 provides an ON signal to the controller 2 when a conveyed sheet S comes in contact with the swing arm 171 and causes the swing arm 171 to swing, and provides an OFF signal to the controller 2 when the rear end of a sheet S passes by the swing arm 171 and lets the swing arm 171 return to its initial position (the position shown in FIG. 1).

The ejection sensor 170 is located in a position downstream of the process unit 31 and upstream of the flapper 140 in a conveyance direction of a sheet S conveyed by the conveyor rollers 110. Specifically, the ejection sensor 170 is located downstream of the fixing device 80 in the conveyance direction of a sheet S conveyed by the conveyor rollers 110; further, the ejection sensor 170 is located downstream of the conveyor rollers 110 in the conveyance direction of a sheet S conveyed by the conveyor rollers 110. Therefore, the ejection sensor 170 is configured to detect a sheet S conveyed from the process unit 31, at a position between the process unit 31 and the flapper 140. To be specific, the ejection sensor 170 is configured to detect a sheet S between the fixing unit 70 (image forming unit 30) and the flapper 140. To be more specific, the ejection sensor 170 is configured to detect a sheet S between a pair of the conveyor rollers 110 and the flapper 140.

The controller 2 is a device for exercising a control over operation of the image forming apparatus 1. The controller 2 includes a central processing unit (CPU), a read only memory (ROM), a random access memory (RAM), an input/output device, etc., and is configured to perform a process by executing pre-stored programs. In the present embodiment, the controller 2 is configured to control the rollers and flapper 140 based on signals from the ejection sensor 170, the rear cover sensor 12S, etc. to eject a sheet S conveyed from the image forming unit 30 selectively onto the output tray 13 or the rear cover 12 in the open position.

The controller 2 executes an initial process upon power-up of the image forming to apparatus 1. One example of the initial process is that the controller 2 executes concurrent processes which include a process of ejecting a sheet S remaining in the image forming unit 30 (hereinafter referred to as "ejection process"), a process of moving each of the development rollers 61 in a contact position to a separate position, a process of collecting toner adhered to the surface of the conveyor belt 73, and/or other processes.

In the ejection process executed upon power-up of the image forming apparatus 1, the controller 2 first causes the photoconductor drums 50, the conveyor belt 73 (drive roller 71), the rollers 81, 82 of the fixing device 80, and the conveyor rollers 110 to rotate.

Thereafter, when the ejection sensor 170 detects a sheet S conveyed from the image forming unit 30 and turns its output on, and if it turns out from a signal from the rear cover sensor 12S that the rear cover 12 is in the open position, the controller 2 exercises the following processes.

The controller 2 does not cause the first rotation-reversible rollers 131 and the second rotation-reversible rollers 132 to rotate. The controller 2 also does not cause the first ejector rollers 121 and the second ejector rollers 122 to rotate as long as the rear cover 12 is in the open position. To be more specific, the controller 2 keeps the first rotation-reversible rollers 131, the second rotation-reversible rollers 132, the first ejector rollers 121, and the second ejector rollers 122 in a nonrotating state.

Figure 6A:
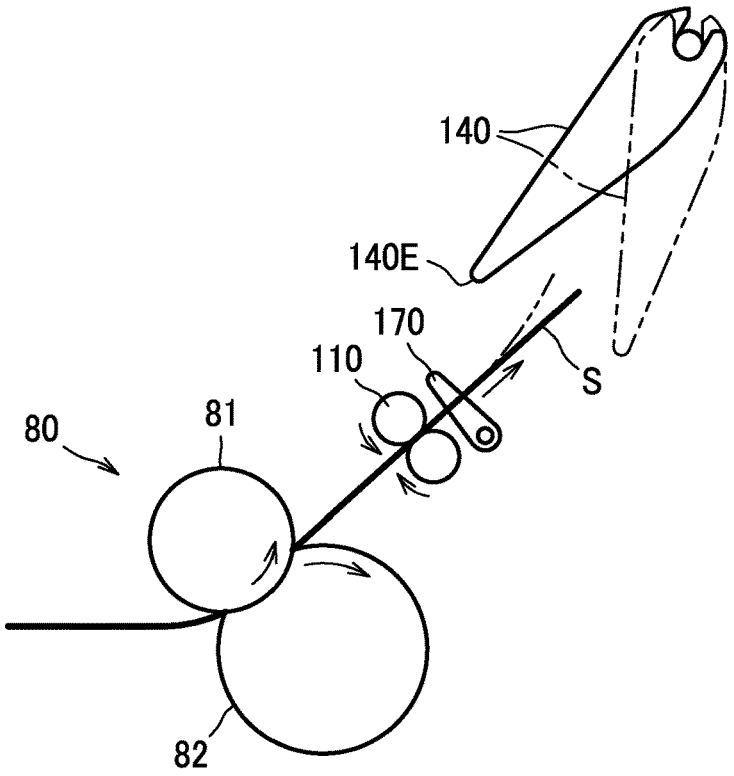
FIGS. 6A and 6B are schematic diagrams showing the motion of the flapper imparted when the rear cover is in the open position during an ejection process.
Figure 6B:
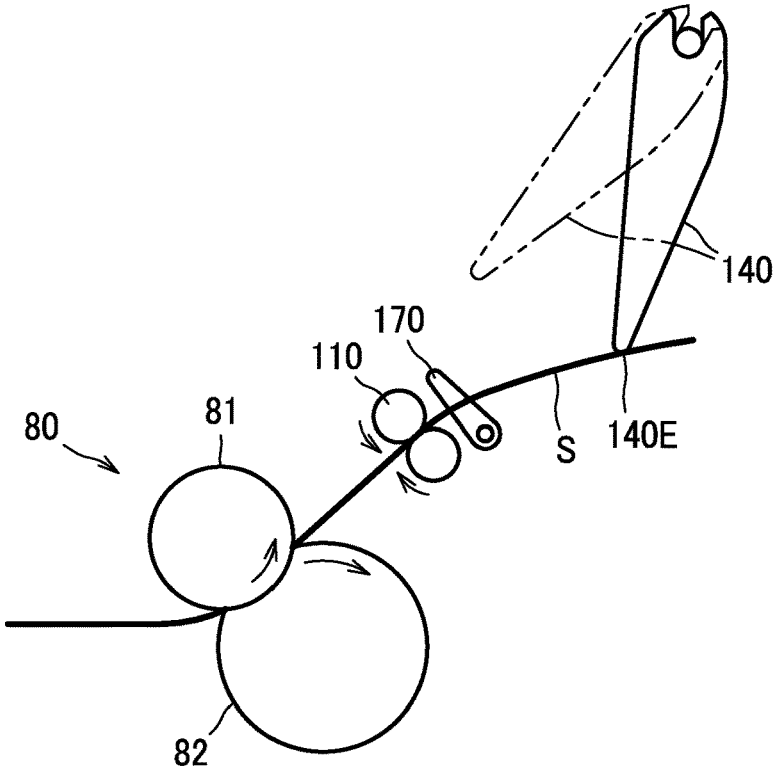

Concurrently, the controller 2 exercises control over the solenoid 142 (see FIG. 2B), and causes the flapper 140 to swing from the first position represented by the chain double-dashed line to the second position represented by the solid line, as shown in FIG. 6A. Thereafter, at a time when the front end of the sheet S reaches a position downstream of an upstream end 140E of the flapper 140 in the conveyance direction of the sheet S conveyed by the conveyor rollers 110, the controller 2 causes the flapper 140 to swing from the second position represented by the chain double-dashed line to the first position represented by the solid line, as shown in FIG. 6B.

Accordingly, the front end of the sheet S conveyed from the image forming unit 30 is flapped and directed toward the rear cover 12 by the flapper 140, so that the sheet S is ejected onto the rear cover 12 in the open position as shown in FIG. 4.

When the rear cover 12 is caused to swing to the closed position during the process of conveyance of a sheet S commenced upon detection of the sheet S by the ejection sensor 170 and executed when the rear cover 12 is in the open position, the controller 2 causes the conveyor rollers 110, etc. to stop rotating. Specifically, when a sheet S is being conveyed, and if it turns out from a signal from the rear cover sensor 12S that the rear cover 12 which was in the open position is closed, the controller 2 causes the conveyor rollers 110, the photoconductor drums 50, the conveyor belt 73 and the rollers 81, 82 of the fixing device 80 to stop rotating.

On the other hand, upon power-up of the image forming apparatus 1, which follows rotations of the conveyor rollers 110, etc., and if the ejection sensor 170 turns its output on, and it turns out from a signal from the rear cover sensor 12S that the rear cover 12 is in the closed position, the controller 2 exercises the following processes.

The controller 2 causes the first ejector rollers 121 and the second ejector rollers 122 to rotate. Concurrently, the controller 140 keeps the flapper 140 in the first position. To be more specific, the controller 2 keeps the solenoid 142 in the OFF state.

Accordingly, as shown in FIG. 2A, a sheet S conveyed from the image forming unit 30 is conveyed by the conveyor rollers 110, guided and introduced into the first conveyor path 120 by the flapper 140 in the first position, and ejected by the ejector rollers 121, 122 onto the output tray 13.

When the rear cover 12 is caused to swing to the open position during the process of conveyance of a sheet S commenced upon detection of the sheet S by the ejection sensor 170 and executed when the rear cover 12 is in the closed position, the controller 2 causes the conveyor rollers 110, the ejector rollers 121, 122, etc. to stop rotating. Specifically, when a sheet S is being conveyed, and if it turns out from a signal from the rear cover sensor 12S that the rear cover 12 which was in the closed position is swung open, the controller 2 causes the conveyor rollers 110, ejector rollers 121, 122, the photoconductor drums 50, the conveyor belt 73 and the rollers 81, 82 of the fixing device 80 to stop rotating. Moreover, if the first rotation-reversible rollers 131 are being caused to rotate together with the ejector rollers 121, 122, etc., the controller 2 causes the first rotation-reversible rollers 131 to stop rotating together with the ejector rollers 121, 122, while if the first rotation-reversible rollers 131 are not being caused to rotate, the controller 2 keeps the first rotation-reversible rollers 131 in a nonrotating state.

Next, the processes of the controller 2 as executed upon power-up will be described more in detail with reference to the flowcharts shown in FIGS. 7 and 8.

Figure 7:
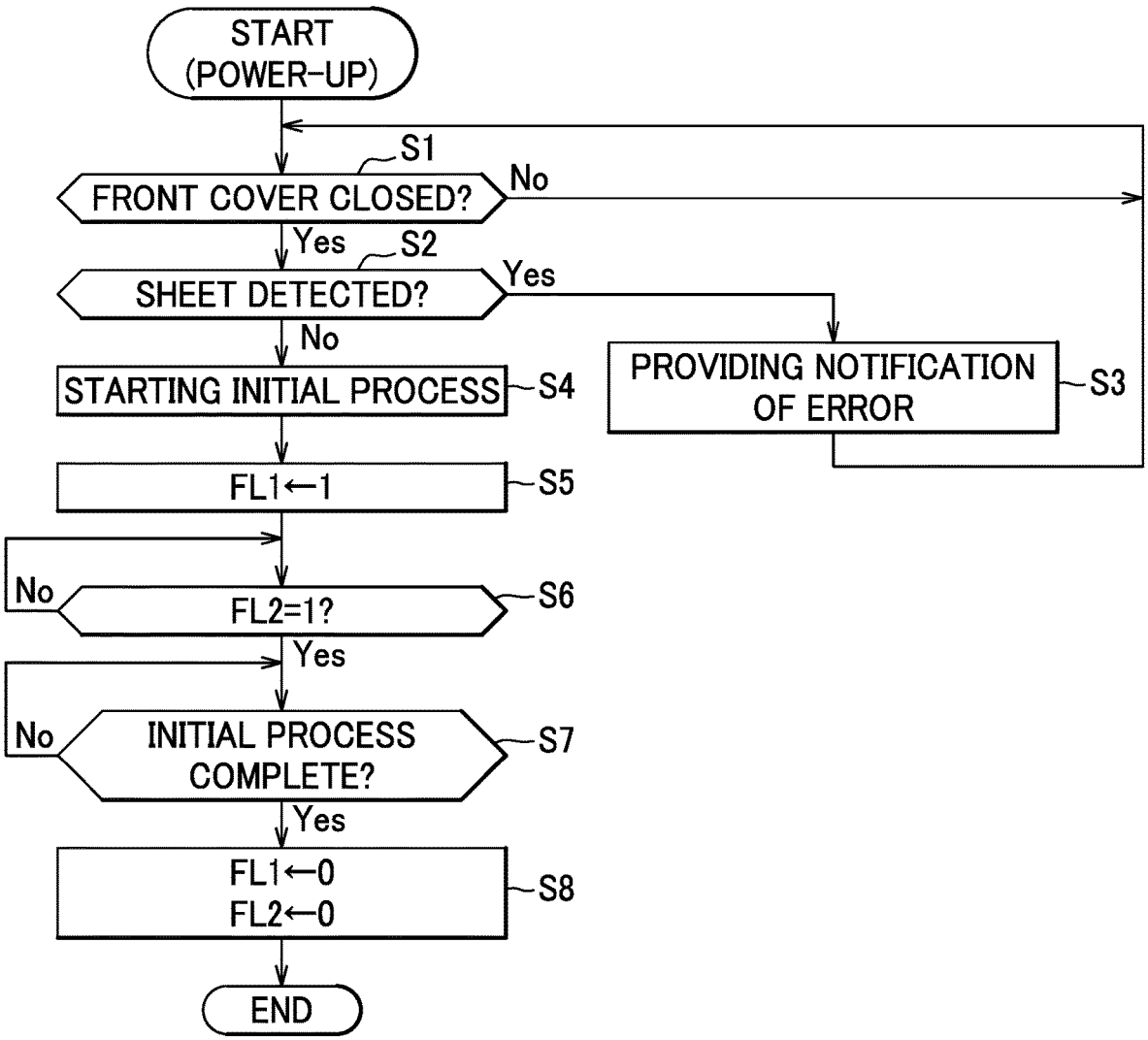
FIG. 7 is a flowchart showing a process of a controller upon power-up.

As shown in FIG. 7, when the power to the image forming apparatus 1 is turned on, the controller 2 makes a determination as to whether or not the front cover 11 is closed (S1).

If the front cover 11 is not closed (No, S1), then the controller 2 waits until the front cover 11 is closed; while if the front cover 11 is closed (Yes, S1), then the controller 2 further makes a determination as to whether or not at least one of the sheet feed sensor 28A, the pre-registration sensor 28B, the post-registration sensor 28C, and the ejection sensor 170 has detected a sheet S (S2). If the sheet S is detected (Yes, S2), then the controller 2 provides a notification of error to a user (S3), and returns to step S1. The manner in which the notification is provided may be any method as deemed appropriate; for example, a message or the like to the effect that a jam of sheet S has occurred may be shown in a display provided on the housing 10.

If it turns out in step S2 that none of the sheet feed sensor 28A, the pre-registration sensor 28B, the post-registration sensor 28C, and the ejection sensor 170 has detected a sheet S (No, S2), then the controller 2 starts an initial process (S4), and sets an ejection process monitoring request flag FL1 at "1" (S5).

Figure 8:
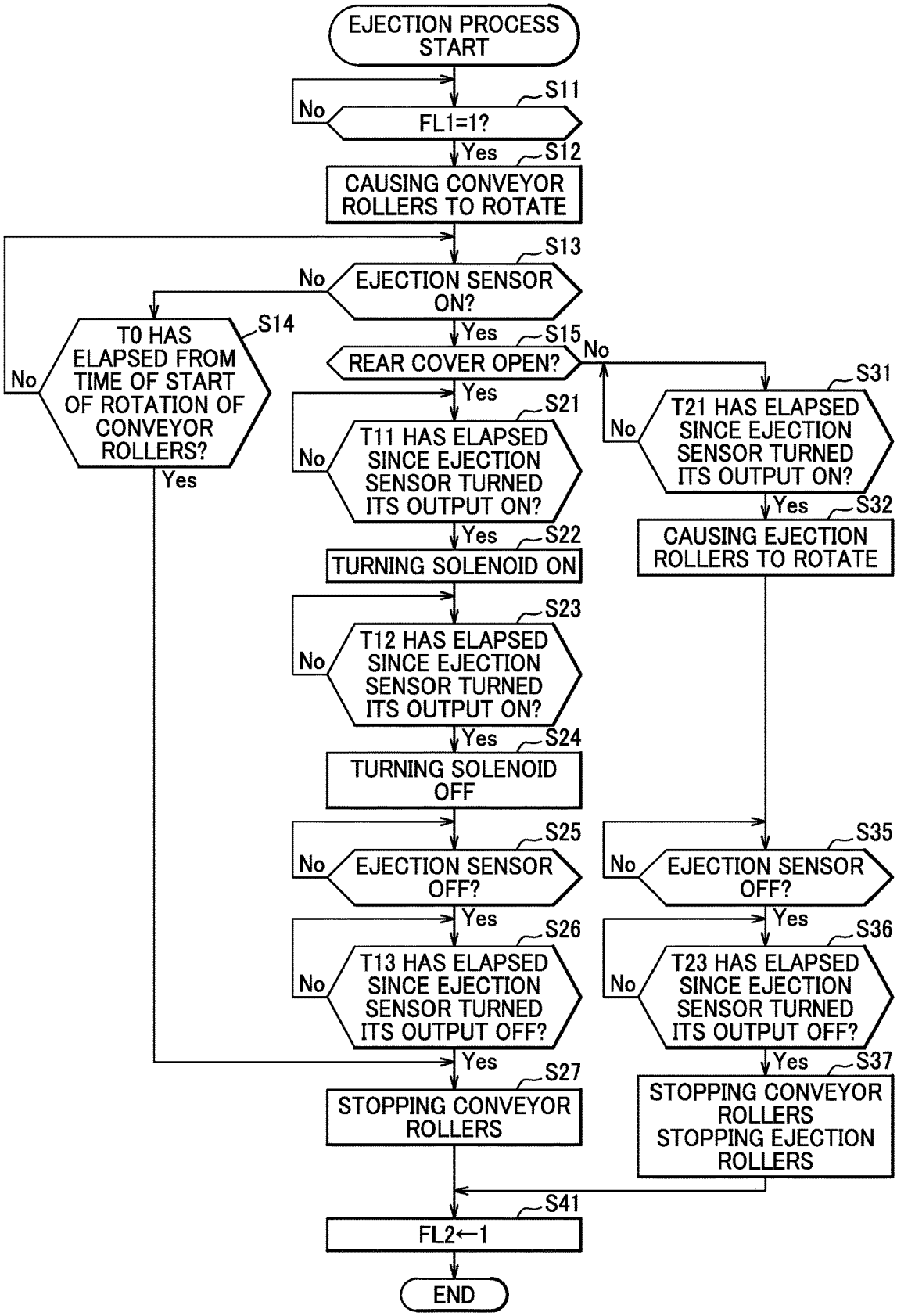
FIG. 8 is a flowchart showing the ejection process.

When the initial process is started (S4), the controller 2 executes the ejection process as shown in FIG. 8, that is one of the sub-processes of the initial process; i.e., initiation of the ejection process is flagged in FL1. In the ejection process, the controller 2 makes a determination as to whether or not the ejection process monitoring request flag FL1 is "1" (S11), and if FL1 is not "1" (No, S11), then waits until FL1 turns out to be "1". If the ejection process monitoring request flag FL1 is "1" (Yes, S11), then the controller 2 causes the conveyor rollers 110, the photoconductor drums 50, the conveyor belt 73, and the rollers 81, 82 of the fixing device 80 to rotate (S12).

Next, the controller 2 makes a determination as to whether or not the ejection sensor 170 turned its output ON (S13). If the ejection sensor 170 is not ON (No, S13), then the controller 2 makes a determination as to whether or not a predetermined time period TO has elapsed from a time of start of rotation of the conveyor rollers 110, etc. (S14). If the predetermined time period TO has not elapsed yet (No, S14), then the controller 2 returns to step S13.

If the determination in step S14 is that the predetermined time period TO has elapsed from the time of start of rotation of the conveyor rollers 110, etc. (Yes, S14), and indicates that no sheet S remains in the image forming unit 30, then the controller 2 causes the conveyor rollers 110, the photoconductor drums 50, the conveyor belt 73, and the rollers 81, 82 of the fixing device 80 to stop rotating (S27).

If the determination in step S13 is that the ejection sensor 170 has turned its output ON (Yes, S13), then the controller 2 makes a determination as to whether or not the rear cover 12 is in the open position (S15).

If the rear cover 12 is in the open position (Yes, S15), then the controller 2 makes a determination as to whether or not a predetermined time period T11 has elapsed since the ejection sensor 170 turned its output ON (S21). If the predetermined time period T11 has not elapsed yet (No, S21), then the controller 2 waits until the predetermined time period T11 elapses, and if the predetermined time period T11 has elapsed (Yes, S21), then the controller 21 turns the solenoid 142 ON (S22). Accordingly, the flapper 140 is caused to swing from the first position to the second position. The predetermined time period T11 is set at a time period for which the flapper 140 can be caused to swing from the first position to the second position without coming in contact with a sheet S conveyed. It is to be understood that the predetermined time period T11 may be 0. That is, the controller 2 may turn the solenoid 142 ON and cause the flapper 140 to swing from the first position to the second position immediately after it turns out in step S15 that the rear cover 12 is in the open position.

After causing the flapper 140 to swing from the first position to the second position, the controller 2 makes a determination as to whether or not a predetermined time period T12 has elapsed since the ejection sensor 170 turned its output ON (S23). If the predetermined time period T12 has not elapsed yet (No, S23), then the controller 2 waits until the predetermined time period T12 elapses, and if the predetermined time period T12 has elapsed (Yes, S23), then the controller 2 turns the solenoid 142 OFF (S24). Accordingly, the flapper 140 is caused to swing from the second position to the first position by the biasing force of the spring 141. The predetermined time period T12 is set at a time period for which the front end of a sheet S reaches a position downstream of the upstream end 140E of the flapper 140 in the conveyance direction of the sheet S conveyed by the conveyor rollers 110.

Thereafter, the controller 2 makes a determination as to whether or not the ejection sensor 170 has turned its output OFF (S25). If the ejection sensor 170 is not OFF (No, S25), then the controller 2 waits until the ejection sensor 170 turns its output OFF, and if the ejection sensor 170 has turned its output OFF (Yes, S25), then the controller 2 makes a determination as to whether or not a predetermined time period T13 has elapsed since the ejection sensor 170 turned its output OFF (S26).

If the predetermined time period T13 has not elapsed yet (No, S26), then the controller 2 waits until the predetermined time period T13 elapses, and if the predetermined time period T13 has elapsed (Yes, S26), then the controller 2 causes the conveyor rollers 110, the photoconductor drums 50, the conveyor belt 73, the rollers 81, 82 of the fixing device 80 to stop rotating (S27). It is to be understood that the predetermined period of time T13 may be 0. That is, the controller 2 may cause the conveyor rollers 110, etc., to stop rotating immediately after it turns out in step S26 that the ejection sensor 170 has turned its output OFF.

After it turns out in step S15 that the rear cover 15 is in the open position, the controller 2 keeps the ejector rollers 121, 122 and the rotation-reversible rollers 131, 132 in a nonrotating to state.

On the other hand, if it turns out in step S15 that the rear cover 12 is in the closed position (No, S15), then the controller 2 makes a determination as to whether or not a predetermined time period T21 has elapsed since the ejection sensor 170 turned its output ON (S31). If the predetermined time period T21 has not elapsed yet (No, S31), then the controller 2 waits until the predetermined time period T21 elapses, and if the predetermined time period T21 has elapsed (Yes, S31), then the controller 2 causes the ejector rollers 121, 122 to rotate (S32). The predetermined time period T21 is set at a time period for which the ejector rollers 121 start rotating in time before the front end of a sheet S conveyed by the conveyor rollers 110 reaches the first ejector rollers 121 so that the sheet S can be conveyed by the first ejector rollers 121 without fail.

Thereafter, the controller 2 makes a determination as to whether or not the ejection sensor 170 has turned its output OFF (S35). If the ejection sensor 170 is not OFF (No, S35), then the controller 2 waits until the ejection sensor 170 turns its output OFF, and if the ejection sensor 170 has turned its output OFF (Yes, S35), then the controller 2 makes a determination as to whether or not a predetermined time period T23 has elapsed since the ejection sensor 170 turned its output OFF (S36).

If the predetermined time period T23 has not elapsed yet (No, S36), then the controller 2 waits until the predetermined time period T23 elapses, and if the predetermined time period T23 has elapsed (Yes, S36), then the controller 2 causes the conveyor rollers 110, ejector rollers 121, 122, the photoconductor drums 50, the conveyor belt 73, the rollers 81, 82 of the fixing device 80 to stop rotating (S37). The predetermined time period T23 is set at a time period for which ejection of a sheet S onto the output tray 13 by the second ejection rollers 122 reaches completion without fail.

When it is determined in step S15 that the rear cover 15 is in the closed position, the controller 2 never causes the solenoid 142 to operate, and keeps the flapper 140 in the first position.

After stopping the conveyor rollers 110, etc. in steps S27, S37, the controller 2 sets an ejection complete flag FL2 at "1" (S41), and brings the ejection process to an end.

Referring back to FIG. 7, in step S6, the controller 2 makes a determination as to whether or not the ejection complete flag FL2 is "1", and if FL2 is not "1" (No, S6), then waits until FL2 turns out to be "1", while if the ejection complete flag FL2 is "1" (Yes, S6), then the controller 2 makes a determination as to whether or not the entire process of the initial process (including all the sub-processes other than the ejection process) is complete (S7). If the initial process is not complete (No, S7), then the controller 2 waits until it is complete, while if the initial process is complete (Yes, S7), then the controller 2 sets the ejection process monitor request flag FL1 at "0", and also sets the ejection complete flag FL2 at "0" (S8), and brings the process to an end.

Although not shown in the flowcharts, in the ejection process, if the rear cover 12 changes its position, i.e., the rear cover 12 in the open position is closed, or the rear cover 12 in the closed position is swung open during the process in which the controller 2 causes the conveyor rollers 110, etc. to rotate to thereby convey a sheet S, then the controller 2 stops the conveyor rollers 110, etc. and discontinues the conveyance of the sheet S.

In the illustrative, non-limiting embodiment described above, the image forming apparatus 1 operates, with advantageous effects achieved, as follows.

In the ejection process, when the rear cover 12 is in the open position, a sheet S can be reliably ejected onto the rear cover 12 without fail, because the flapper 140 is caused to swing from the first position to the second position beforehand as shown in FIG. 6A, and at a predetermined time when the front end of the sheet S reaches a position downstream of the upstream end 140E of the flapper 140, the flapper 140 is caused to swing from the second position to the first position as shown in FIG. 6B, so that the front end of the sheet S being conveyed can be flapped and directed toward the rear cover 12.

Moreover, in this process, the first rotation-reversible rollers 131 uncovered when the rear cover 12 is in the open position as shown in FIG. 4 are not caused to rotate; therefore, even if anything would contact the exposed first rotation-reversible rollers 131, an undesirable overload which would be imposed by such contact if the first rotation-reversible rollers 131 are rotating can be made less likely to be imposed on the first rotation-reversible rollers 131.

Since the conveyor rollers 110, etc. are stopped if the rear cover 12 in the open position is closed in the ejection process, a sheet S on its way of conveyance, and any subsequent sheets S, can be prevented from being conveyed further. Accordingly, excessive warpage and resulting jam of the sheet S inside the closed rear cover 12 can be restrained.

In the ejection process, when the rear cover 12 is in the closed position, as shown in FIG. 2A, a sheet S can be guided and introduced into the first conveyor path 120, conveyed by the ejector rollers 121, 122, and ejected onto the output tray 13, because the ejector rollers 121, 122 are caused to rotate and the flapper 140 is kept in the first position.

Since the conveyor rollers 110, the ejector rollers 121, 122, the rotation-reversible rollers 131, 132 are stopped if the rear cover 12 in the closed position is swung open during the ejection process, a sheet S on its way of conveyance, and any subsequent sheets S, can be prevented from being conveyed further. Accordingly, collision of the front end of the sheet S with an unintended, not properly guiding portion and resulting excessive warpage of the sheet S can be restrained. Furthermore, since the first rotation-reversible rollers 131 uncovered due to opening of the rear cover 12 are not caused to rotate, an undesirable overload which would be imposed on the first rotation-reversible rollers 131, if the first rotation-reversible rollers 131 are rotating, upon accidental contact of anything with the exposed first rotation-reversible rollers 131, can be made less likely to be imposed on the first rotation-reversible rollers 131.

Since the arrangement made available as shown in FIG. 5 in which the rear cover 12 is in the open position and the inner cover 160 is in the fourth position can make the first conveyor path 120 uncovered and open for access, a sheet S jammed in the first conveyor path 120 can be removed with increased ease. On the other hand, even if conveyance of a sheet S for the ejection process starts when the rear cover 12 is in the open position and the inner cover 160 is in the fourth position, an undesirable overload which would be imposed on the first ejector rollers 121, if the first ejector rollers 121 are rotating upon accidental contact of anything with the exposed first ejector rollers 121, can be made less likely to be imposed on the first ejector rollers 121 because the exposed first ejector rollers 121 are not caused to rotate.

Since the ejection sensor 170 is located in a position downstream of the fixing device 80 in the conveyance direction of a sheet S, the sheet S comes in contact with the ejection sensor 170 after a toner image is fixed on the sheet S. Therefore, disturbance of the toner image can be prevented so that degradation of image quality can be restrained.

In the image forming apparatus 1 with the process unit 31 configured to form toner images of a plurality of colors transferable onto a sheet S, the larger amount of toner put on the sheet S than in a monochrome image forming apparatus would make the sheet S with toner fixed thereon liable to curl up as represented by a chain double-dashed line in FIG. 6A away from the rear cover 12 in the open position. If the sheet S curled were conveyed as-is, the front end of the sheet S would, for example, collide with the first rotation-reversible rollers 131, etc., and the sheet S, if conveyed further by the conveyor rollers 110, would possibly deform. Therefore, the image forming apparatus 1 particularly benefits from the feature of the flapper 140 flapping and directing the front end of a sheet S toward the rear cover 12 in order to eject reliably the sheet S onto the rear cover 12 in the open position without fail.

The above-described embodiment may be implemented in various other forms as described below.

For example, the biasing member configured to bias a flapper toward the first position may not be a torsion spring like the spring 141 illustrated herein, but may be a coil spring, or the like.

The image forming apparatus 1 may not be configured such that upon power-up of the image forming apparatus 1, the controller 2 causes the conveyor rollers 110, etc. to rotate, and when the ejection sensor 170 detects a sheet S, exercises control over the rollers and the flapper 140 in the specific manners varying according to the positions of the rear cover 12, but may be configured such that in response to an event other than the power-up of the image forming apparatus 1, the controller 2 causes the conveyor rollers 110, etc. to rotate, and when the ejection sensor 170 detects a sheet S, exercises control over the rollers and the flapper 140 in the specific manners varying according to the position of the rear cover 12. Such an event other than the power-up of the image forming apparatus 1 may take place, for example, in an ejection step of a normal printing process for forming an image on a sheet; i.e., the controller may cause the first conveyor rollers 110, etc. to rotate when a sheet with an image formed thereon is ejected, and exercise the same control over the rollers and the flapper 140 as described above when the ejection sensor 170 detects a sheet. In this alternative configuration, as well, when the rear cover 12 is in the open position, the sheet S can be ejected reliably onto the rear cover 12 without fail, and an undesirable overload can be made less likely to be imposed on the first rotation-reversible rollers 131.

The inner cover 160 described above may not be an essential feature of the image forming apparatus 1. The image forming apparatus configured to include no second cover may be feasible.

The second conveyor path 130 described above may not be an essential feature of the image forming apparatus 1. The image forming apparatus may include no second conveyor path. In this alternative configuration, the image forming apparatus may be configured, for example, such that when the first cover is in the closed position, a sheet conveyed by the first conveyor roller is guided and directed into the first conveyor path.

This configuration may be such that the first cover in the closed position makes up at least part of the first conveyor path and covers the conveyor roller configured to convey a sheet in the first conveyor path, and in the open position uncovers that conveyor roller. Herein, the controller may be configured for example such that the flapper in the first position guides a sheet conveyed by the first conveyor roller into the first conveyor path, and in the second position lies farther away from the first cover than in the first position so that its upstream end is kept out of a trajectory of a sheet conveyed by the first conveyor roller and ejected onto the first cover in the open position. The controller is configured such that upon power-up of the image forming apparatus, the first conveyor roller is caused to rotate, and if the first cover is in the open position when the sheet sensor detects a sheet, the conveyor roller uncovered when the first cover is in the open position is not caused to rotate.

The sheet sensor is exemplified above by the ejection sensor 170 configured to detect a sheet S when the conveyed sheet S comes in contact with the ejection sensor 170, but may be configured otherwise. For example, the sheet sensor may not be such a contact-type sheet sensor, but may be a non-contact type sheet sensor. In this alternative example, the sheet sensor may be located in a position upstream of the fixing device, i.e., between the process unit and the fixing device, in the conveyance direction of a sheet conveyed by the first conveyor rollers.

The fixing device, exemplified above by the fixing device 80 including a heating roller 81 and a pressure roller 82, may be configured otherwise; for example, the fixing device may be a belt-type fixing device in which at least one of a heating unit and a pressure unit includes an endless belt.

Although the image forming apparatus 1 capable of forming a toner image with toner of four colors is illustrated by way of example, an image forming apparatus capable of forming a toner image, for example, with toner of two, three, five or more colors may also be implemented in such a manner as described above. An image forming apparatus for forming an image with toner of a single color may also be feasible. In other words, the process unit may not be configured to be capable of transferring onto a sheet a toner image in a plurality of colors, but may be configured to transfer onto a sheet a toner image in a single color only. The image forming apparatus may not be a printer, and may be a multifunction machine, a copier, or the like.

The elements described in the above embodiment and its modified examples may be implemented selectively and in combination.

What is claimed is:

1. An image forming apparatus comprising:

a housing;

a process unit configured to transfer a toner image onto a sheet;

a first conveyor roller configured to convey the sheet conveyed from the process unit;

an output tray configured to support a sheet;

a first conveyor path provided within the housing, and configured to guide the sheet conveyed by the first conveyor roller toward the output tray;

a second conveyor path branching off from the first conveyor path, and configured to guide the sheet conveyed by the first conveyor roller toward outside of the housing;

a second conveyor roller configured to convey the sheet in the second conveyor path;

a first cover provided swingably relative to the housing between a closed position and an open position, wherein the first cover in the closed position makes up at least part of the second conveyor path and covers the second conveyor roller, and in the open position uncovers the second conveyor roller;

a flapper provided swingably between a first position and a second position, wherein the flapper in the first position guides the sheet conveyed by the first conveyor roller into the first conveyor path, and in the second position guides the sheet conveyed by the first conveyor roller into the second conveyor path when the first cover is in the closed position, and the flapper guides the sheet conveyed by the first conveyor roller to eject the sheet onto the first cover when the first cover is in the open position;

a biasing member configured to bias the flapper toward the first position;

an actuator configured to cause the flapper to swing from the first position to the second position;

a sheet sensor configured to detect a conveyed sheet at a position between the process unit and the flapper; and a controller configured such that:

upon power-up of the image forming apparatus, the first conveyor roller is caused to rotate; and if the first cover is in the open position, when the sheet sensor detects a sheet, the second conveyor roller is not caused to rotate, and the flapper is caused, by the actuator, to swing from the first position to the second position, and when a front end of the sheet reaches a position downstream of an upstream end of the flapper in a conveyance direction of the sheet conveyed by the first conveyor roller, the flapper is caused, by the actuator, to swing from the second position to the first position.

2. The image forming apparatus according to claim 1, wherein the controller is further configured such that if the first cover is in the open position when the sheet sensor detects a sheet, and if the first cover is swung to the closed position during conveyance of the sheet, the first conveyor roller is stopped.

3. The image forming apparatus according to claim 1, further comprising a third conveyor roller configured to convey a sheet in the first conveyor path, wherein the controller is further configured such that:

upon power-up of the image forming apparatus, the first conveyor roller is caused to rotate; and if the first cover is in the closed position, when the sheet sensor detects a sheet, the third conveyor roller is caused to rotate, and the flapper is kept in the first position.

4. The image forming apparatus according to claim 3, wherein the controller is further configured such that if the first cover is in the closed position when the sheet sensor detects a sheet, and if the first cover is swung to the open position during conveyance of the sheet, the first conveyor roller, the second conveyor roller, and the third conveyor roller are stopped.

5. The image forming apparatus according to claim 3, further comprising a second cover that is uncovered when the first cover is in the open position, wherein the second cover is movable relative to the housing between a third position and a fourth position, wherein the second cover in the third position makes up at least part of the first conveyor path and covers the third conveyor roller, and in the fourth position uncovers the third conveyor roller, and wherein the controller is further configured such that if the first cover is in the open position, the third roller is not caused to rotate.

6. The image forming apparatus according to claim 1, further comprising a fixing device configured to cause a toner image transferred onto a sheet in the process unit to be fixed on the sheet, wherein the sheet sensor is configured to detect a sheet upon contact with the sheet being conveyed, the sheet sensor being located downstream of the fixing device in the conveyance direction.

7. The image forming apparatus according to claim 1, further comprising a fixing device configured to cause a toner image transferred onto a sheet in the process unit to be fixed on the sheet, wherein the process unit is capable of transferring onto the sheet a toner image in a plurality of colors.

8. An image forming apparatus comprising:

a housing;

a process unit configured to transfer a toner image onto a sheet;

a first conveyor roller configured to convey the sheet conveyed from the process unit;

an output tray configured to support a sheet;

a first conveyor path provided within the housing, and configured to guide the sheet conveyed by the first conveyor roller toward the output tray;

a second conveyor path branching off from the first conveyor path, and configured to guide the sheet conveyed by the first conveyor roller toward outside of the housing;

a second conveyor roller configured to convey the sheet in the second conveyor path;

a first cover provided swingably relative to the housing between a closed position and an open position, wherein the first cover in the closed position makes up at least part of the second conveyor path and covers the second conveyor roller, and in the open position uncovers the second conveyor roller;

a flapper provided swingably between a first position and a second position, wherein the flapper in the first position guides the sheet conveyed by the first conveyor roller into the first conveyor path, and in the second position guides the sheet conveyed by the first conveyor roller into the second conveyor path when the first cover is in the closed position, and the flapper guides the sheet conveyed by the first conveyor roller to eject the sheet onto the first cover when the first cover is in the open position;

a biasing member configured to bias the flapper toward the first position;

an actuator configured to cause the flapper to swing from the first position to the second position;

a sheet sensor configured to detect a conveyed sheet at a position between the process unit and the flapper; and a controller configured such that:

if the first cover is in the open position, when the sheet sensor detects a sheet after the first conveyor roller is caused to rotate, the second conveyor roller is not caused to rotate, and the flapper is caused, by the actuator, to swing from the first position to the second position, and when a front end of the sheet reaches a position downstream of an upstream end of the flapper in a conveyance direction of the sheet conveyed by the first conveyor roller, the flapper is caused, by the actuator, to swing from the second position to the first position.

* * * * *